US006275596B1

(12) United States Patent
Fretz et al.

(10) Patent No.: US 6,275,596 B1
(45) Date of Patent: Aug. 14, 2001

(54) OPEN EAR CANAL HEARING AID SYSTEM

(75) Inventors: Robert J. Fretz, Maplewood; Paul H. Stypulkowski, North Oaks, both of MN (US); Richard T. Woods, Atlanta, GA (US)

(73) Assignee: GN ReSound Corporation, Redwood City, CA (US)

( * ) Notice: Subject to any disclaimer, the term of this patent is extended or adjusted under 35 U.S.C. 154(b) by 0 days.

(21) Appl. No.: 08/781,714

(22) Filed: Jan. 10, 1997

(51) Int. Cl.[7] ..... H04R 25/00

(52) U.S. Cl. ..... 381/321; 381/328; 381/330

(58) Field of Search ..... 381/68, 68.2, 68.3, 381/68.4, 68.5, 68.6, 68.7, 60, 312, 314, 317, 318, 328, 320, 321, 322, 106, 107, 330, 380, 381, 382; 73/585; 128/746; 181/129, 130, 135

(56) References Cited

U.S. PATENT DOCUMENTS

| | | | | |
|---|---|---|---|---|
| 3,170,046 | * | 2/1965 | Leale | 381/328 |
| 3,536,861 | | 10/1970 | Dunlavy . | |
| 3,934,100 | | 1/1976 | Harada . | |
| 3,975,599 | | 8/1976 | Johanson . | |
| 3,983,336 | | 9/1976 | Malek et al. . | |
| 4,090,040 | | 5/1978 | Berland . | |
| 4,450,930 | | 5/1984 | Killion . | |
| 4,677,679 | * | 6/1987 | Killion | 381/382 |
| 4,751,738 | | 6/1988 | Widrow et al. . | |
| 4,869,339 | | 9/1989 | Barton . | |
| 4,904,078 | | 2/1990 | Gorike . | |
| 5,031,219 | * | 7/1991 | Ward et al. | 381/328 |
| 5,033,090 | | 7/1991 | Weinrich . | |
| 5,091,952 | | 2/1992 | Williamson et al. . | |
| 5,113,967 | | 5/1992 | Killion et al. . | |
| 5,201,006 | | 4/1993 | Weinrich . | |
| 5,201,007 | | 4/1993 | Ward et al. . | |
| 5,276,739 | | 1/1994 | Krokstad et al. . | |
| 5,278,912 | | 1/1994 | Waldhauer . | |
| 5,488,205 | | 1/1996 | Major . | |
| 5,488,668 | | 1/1996 | Waldhauer . | |
| 5,500,902 | | 3/1996 | Stockham, Jr. et al. . | |
| 5,524,056 | | 6/1996 | Killion et al. . | |
| 5,572,594 | * | 11/1996 | Devoe et al. | 381/328 |
| 5,987,146 | * | 11/1999 | Pluvinage et al. | 381/328 |
| 6,021,207 | * | 2/2000 | Puthuff et al. | 381/330 |

FOREIGN PATENT DOCUMENTS

| | | |
|---|---|---|
| 33 28 100 | 2/1984 | (DE) . |
| 0 364 037 | 4/1990 | (EP) . |
| 0 512 354 | 11/1992 | (EP) . |

OTHER PUBLICATIONS

"An Investigation Into Sound Attenuation By EarMould Tubing" by L. Flack et al, "British Journal Of Audiology", 1995, 29 237, a copy of p. 237 (1 of 8 pages).
"Handbook of Hearing Aid Amplification vol. 1: Theoretical and Technical Considerations" edited by Robert Sandlin, pp. 71–79 (1988).
"Hearing Aids: Standards, Options, and Limitations" edited by Michael Valente, pp. 264–268 (1996).
"Hearing Instrument Science and Fitting Practices" edited by Robert Sandlin, pp. 329–333 (1996).
"Hearing Instrument Science and Fitting Practices" Edited by Robert E. Sandlin. Ph.D, 1985, Library of Congress 85–060931; National Institute for Hearing Instruments Studies, Livonia, MI, 4 pages.
Translation of 512354A1.

* cited by examiner

*Primary Examiner*—Huyen Le
(74) *Attorney, Agent, or Firm*—Burns, Doane, Swecker & Mathis, LLP

(57) ABSTRACT

An open ear canal hearing aid system comprises an ear canal tube sized for positioning in an ear canal of a user so that the ear canal is at least partially open for directly receiving ambient sounds. The open ear canal hearing aid system further comprises a sound processor for amplifying received ambient sounds included within a predetermined frequency to produce processed sounds and for supplying said processed sounds to said ear canal tube.

32 Claims, 6 Drawing Sheets

OPEN EAR CANAL HEARING AID SYSTEM

BACKGROUND OF THE INVENTION

1. Field of the Invention

The present invention relates to an open ear canal hearing aid system. More particularly, the present invention relates to an open ear canal hearing aid system including a sound processor for amplifying sounds included within a predetermined amplitude and frequency range.

2. State of the Art

Present day hearing aids have been developed to correct the hearing of users having various degrees of hearing impairments. It is well known that the hearing loss of people is generally not uniform over the entire audio frequency range. For instance, hearing loss for sounds at high audio frequencies (above approximately 1000 Hz) will be more pronounced for some people with certain common hearing impairments while hearing loss for sounds at lower frequencies (below approximately 1000 Hz) will be more pronounced for people having different hearing impairments.

The largest population of people having hearing impairments includes those having mild hearing losses with normal hearing in the low frequency ranges and hearing losses in the higher frequency ranges. In particular, the most problematic sounds for people having such mild hearing losses are high frequency sounds at low amplitudes (soft sounds).

The traditional approach for correcting hearing impairments has been to employ electronic "In-The-Ear" (ITE) hearing aid devices inserted into the ear and "Behind-The-Ear" (BTE) hearing aid devices attached behind the ear. Then, through various signal processing techniques, the sounds to be delivered to the ear are rebuilt and supplemented to facilitate and optimize the hearing of the user throughout the frequency range. Such devices tend to block the ear canal so that little or no sounds reach the ear in a natural, unaided manner.

Conventional hearing aids generally provide adequate hearing throughout the entire frequency range for most hearing impairments. However, these types of devices are not optimal for those people having mild hearing losses for a number of reasons. Conventional hearing aids can unnecessarily amplify loud low frequency and high frequency sounds so that these sounds become uncomfortable and annoying to the mild hearing loss users. In many hearing aids, such loud sounds are also distorted by the sound processing circuitry, significantly reducing the intelligibility of speech or the quality of other sounds. In addition, these types of hearing aids add phase shifts to low frequency sounds, resulting in a degradation of the user's ability to localize sound sources. In effect, traditional hearing aids degrade certain sounds that the mild hearing loss user could otherwise hear adequately without any aid. Additionally, these traditional hearing aids are overly complicated and burdensome to users having mild hearing losses.

Efforts have been made to provide different gains for sounds of different frequencies, depending on the hearing needs of the user. For example, U.S. Pat. No. 5,276,739 to Krokstad discloses a device which amplifies sounds with different gains according to the frequencies of the sounds. While this device provides an improved gain response, it processes sounds across the entire frequency range, including low frequency sounds. Thus, this device suffers from the same problems noted above in accommodating the mild hearing loss user.

Other attempts to provide different gains for sounds of different frequencies employ multiband compression in which sounds of different frequency bands and different amplitudes are compressed by different amounts. For example, U.S. Pat. Nos. 5,278,912 and 5,488,668 to Waldhauer disclose multiband compression for hearing aids. Such systems apply compression to the entire frequency range, including low frequency signals. In the case of a user with mild hearing loss, compression for low frequency sounds is not needed. Applying compression to low frequency sounds thus results in a waste of money and space for the circuitry required to perform such compression.

Conventional hearing aid systems cause an additional problem known as the occlusion effect. The occlusion effect is the increased transmission of sound by bone conduction when the ear canal is blocked and air conduction is impeded, resulting in sounds which are both unnatural and uncomfortable for the user. In particular, the user's voice sounds different than normal when the ear is blocked.

Vents have been introduced in hearing aid systems to reduce the occlusion effect as well as to reduce low frequency gain and to shape frequency responses. Such vents only reduce the occlusion effect partially. The occlusion effect therefore remains another drawback to using these traditional hearing aid systems.

In an effort to alleviate some of the aforementioned problems, some BTE aids have been designed with a tube fitting. These types of aids include a tube that extends into the ear canal and is held in place by an ear mold that leaves the ear canal generally unobstructed. The relatively open ear canal overcomes some of the problems mentioned above. However, these types of aids suffer from a number of other significant problems.

For example, like other BTE hearing aids, the "tube fitting" aids typically employ a rigid ear hook that connects to a soft tube which in turn connects to a rigid ear mold. The soft, shapeless tubing is simple to use, but has the disadvantage that the tube does not hold the device in place. The result is that this type of BTE hearing aid requires a large ear hook and a large, hard, close-fitting ear mold to maintain the position of the tube within the ear canal. The large size of these components results in a cosmetically unattractive device. Also, the ear mold has to be custom-manufactured, which adds to the cost of the device and the time needed to fit the hearing aid.

Another problem with the "tube fitting" hearing aid is that this type of hearing aid does not have a compression system that meets the needs of the user in an optimum way. As mentioned above, only multiband compression designs respond adequately to combinations of high and low frequency inputs. However, such systems are complex and expensive for use with mild loss patients. Thus, the "tube fitting" hearing aids suffer from the same problems noted above with regard to other types of hearing aids.

U.S. Pat. No. 4,904,078 to Gorike discloses another type of BTE device in which the hearing aid is formed in a pair of eyeglasses. The eyeglass aid leaves the ear canal open but is cosmetically unattractive. Also, the user is required to wear a custom made pair of eyeglasses, which adds to the cost of the device.

None of the above-described systems are directed to a hearing aid system which specifically solves only the hearing needs of people having mild hearing loss. Because people with mild hearing loss have normal hearing for many sounds, it is desirable to provide a hearing aid system which allows these sounds to pass through the ear canal unaided and to be heard in a natural manner and to only compensate and aid the sounds that the user has difficulty hearing. It is further desirable that such a hearing aid be cosmetically attractive and comfortable to wear.

SUMMARY OF THE INVENTION

According to the present invention, an open ear canal hearing aid system comprises an ear canal tube sized for positioning in an ear canal of a user so that the ear canal is at least partially open for directly receiving ambient sounds. The open ear canal hearing aid system further comprises a sound processor for amplifying received ambient sounds included within a predetermined frequency range to produce processed sounds and for supplying said processed sounds to said ear canal tube. Providing gain for a desired range of frequencies and amplitudes allows the benefit of simpler and lower power hearing aid components, resulting in a smaller and lower cost device. Thereby, the present open ear canal hearing aid system provides a simple, comfortable, and cosmetically attractive hearing aid system that is specifically tailored for users having certain hearing deficiencies and which does not require custom manufacturing.

BRIEF DESCRIPTION OF THE DRAWINGS

The present invention will be understood by reading the following detailed description in conjunction with the drawings, in which like parts are identified with the same reference characters and in which.

DETAILED DESCRIPTION OF THE PREFERRED EMBODIMENTS

Figure 1:
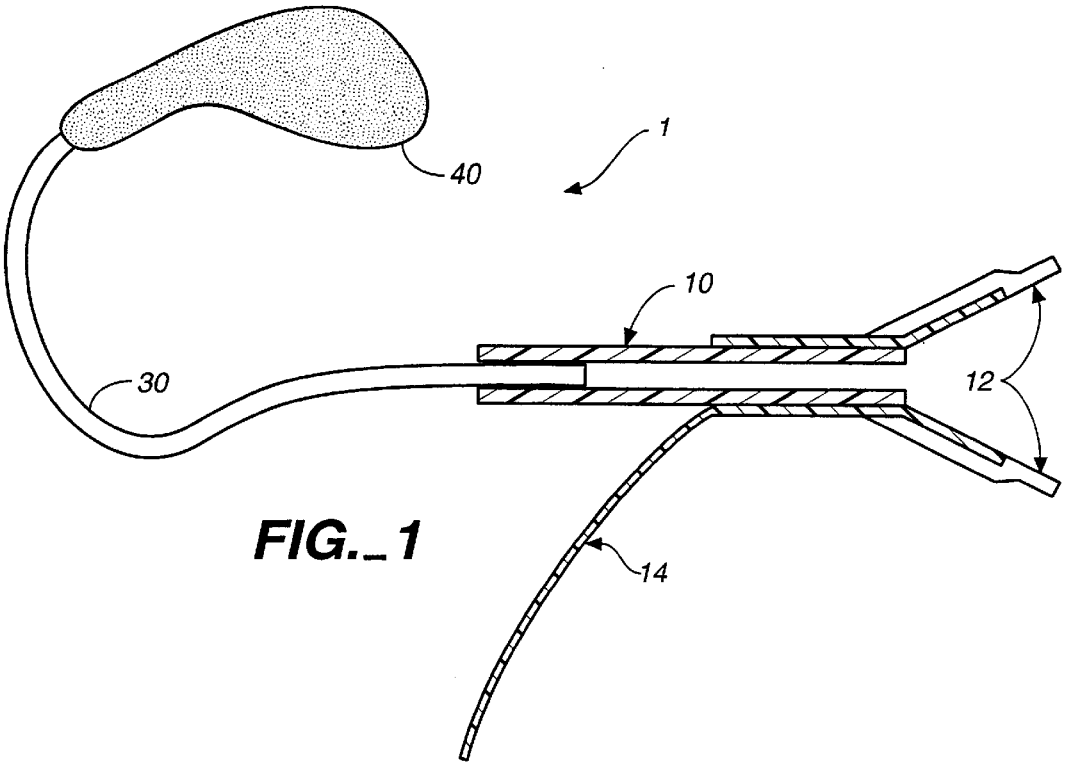
FIG. 1 shows an open ear canal hearing aid system according to one embodiment of the present invention.

In FIG. 1, an open ear canal hearing aid system 1 includes an ear canal tube 10 sized for positioning in the ear of a user so that the ear canal is at least partially open for directly receiving ambient sounds. The ear canal tube 10 is connected to a hearing aid tube 30. This connection can be made by tapering the ear canal tube 10 so that the hearing aid tube 30 and the ear canal tube 10 fit securely together. Alternately, a connector or the like can be used for connecting the ear canal tube 10 and the hearing aid tube 30, or the hearing aid tube 30 and the ear canal tube 10 can be incorporated into a single tube.

The hearing aid tube 30 is also connected to a case 40. The case 40 encloses a sound processor, a receiver, and a microphone, as described with reference to FIG. 6.

According to an exemplary embodiment, the case 40 is designed to fit behind the ear. However, the case 40 can be designed to fit in other comfortable or convenient locations. For example, the case 40 can be attached to an eye glass frame.

FIG. 1 further shows a barb 14 that can be attached to one side of the ear canal tube 10. The barb 14 extends outward from the ear canal tube 10 so that it lodges behind the tragus for keeping the ear canal tube 10 properly positioned in the ear canal. The arrangement of the barb 14 in the ear canal is described in more detail with reference to FIGS. 5*a* and 5*b*. The barb 14 can be made of soft material (e.g., rubber-like material) so as not to scratch the ear tissue. At the end of the ear canal tube 10, the tip 12 can be soft so that the ear canal wall does not become scratched.

The tube 10 can be formed to the contour of the ear and can be made of a material that has some stiffness (e.g., plastic or other material). This makes the whole assembly, including the case 40, the tubes 10 and 30, the barb 14, and the tip 12, work as a unit to hold everything in place. The tube 10 can be made flexible enough to allow the hearing aid to be inserted and removed easily.

The tubing used for the tubes 10 and 30 can have a circular, oval, or other shaped cross section. An oval shape, for example, allows the tubing to bend more easily in one dimension than in the other. This can be useful for allowing the tip end or the case end to be positioned up and down vertically while maintaining the tube 10 inside the canal.

According to an exemplary embodiment of the present invention, the tubing can be made small and thin. For example, the tubing can have an inner diameter of less than 0.030 inches, approximately 0.025 inches, and an outside diameter of less than 0.050 inches, approximately 0.045 inches, for most uses (compared to an outer diameter of 0.125 inches in conventional hearing aid systems or, a diameter of at least approximately 0.085 inches). Thus, exemplary embodiments operate with an outside tube diameter below that of known hearing aid systems (i.e., less than approximately 0.085 inches). This small size makes the tubing less visible and therefore more cosmetically attractive.

In addition to the attractiveness of the small size, the small tubing provides at least one advantage for the receiver. Typical receivers are optimized for driving the low impedance of large diameter tubes or the even lower impedance of the canal cavity. This results in a large diaphragm and a large "dead space" behind the diaphragm. With the small tubing, the load is a high impedance, so the optimum diaphragm is much smaller and the "dead space" can be smaller without affecting the performance.

Figure 2:
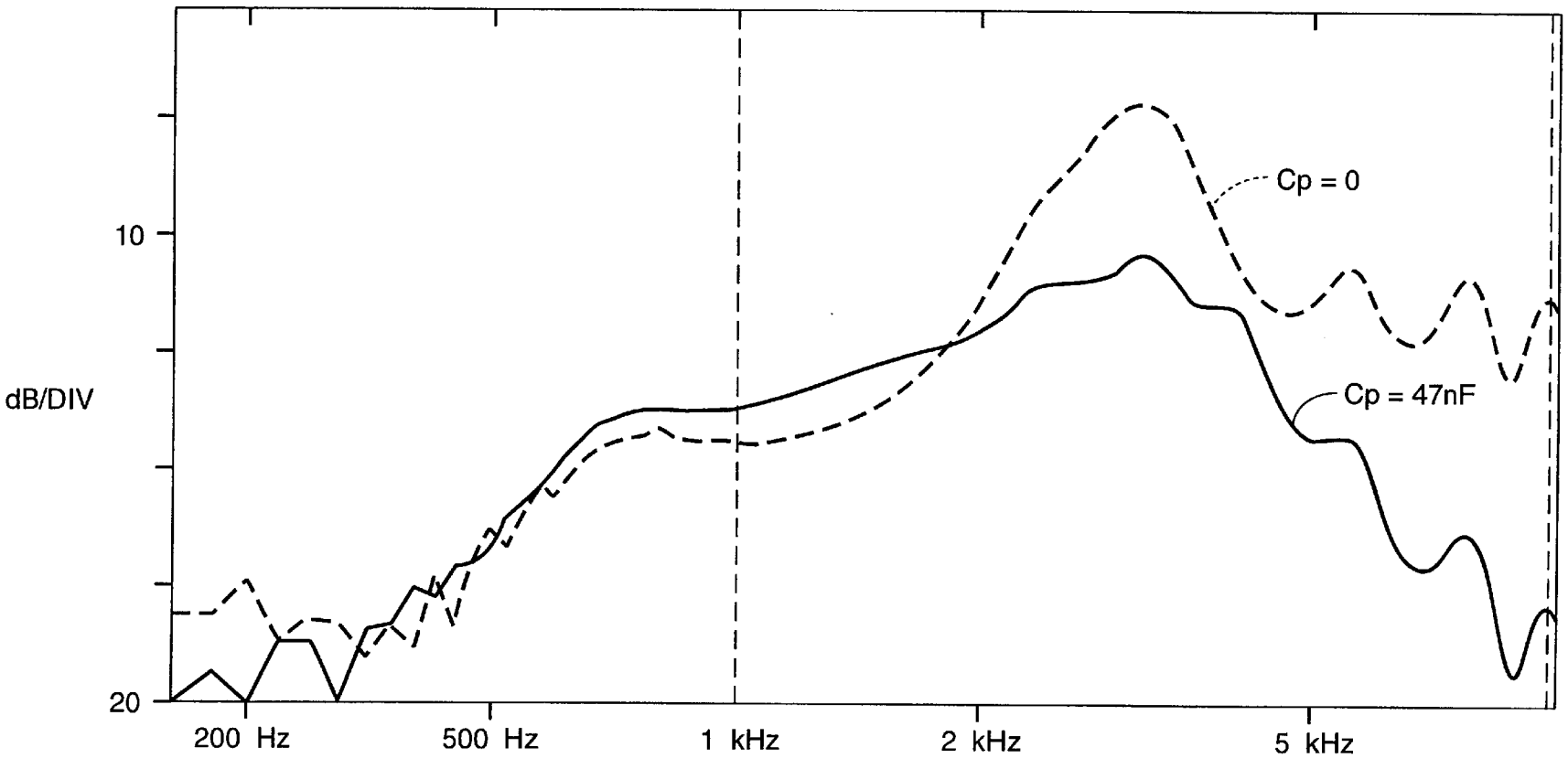
FIG. 2 is a graph which represents an example of the gain for various frequency input levels of sound received by an open ear canal hearing aid system having a small ear canal tube.

The present invention addresses the problem that, as the diameter of the tubing decreases, the frequency response varies farther from the desired shape. This is illustrated in FIG. 2 which shows a frequency response for a common class B receiver connected to a real ear simulator with a small diameter tube. The dashed line in FIG. 2 represents a normal frequency response with no capacitor connected to the receiver. As can be seen from FIG. 2, there is a large peak near 3 kHz. This can be a desirable response for some users, but not for others. The solid curve in FIG. 2 represents a frequency response using a 47 nf capacitor in parallel with the receiver when driven in the current mode. In this example, the receiver used was a Knowles model EH 3065. The capacitor helps shape the frequency response to a shape that is the preferred shape for most users. Other frequency shaping means can also be used to shape the frequency response, such as active electrical filters or acoustical filters. Additionally, the tip 12 can have different shapes or include horns which vary the frequency response, as explained with reference to FIGS. 3*a*–3*d*.

The tip 12 can be a separate component that fits over the tube 10 or can be formed as part of the tube. Using separate components for the tip 12 and the tube 10 permits more adjustment of each of these components and permits the materials of these components to be separately optimized.

Another advantage in using a separate tip is that the tip can be formed to provide modification of the frequency shape. As shown in FIG. 1, the tip 12 can be flared or have an acoustic damper to provide improved acoustic matching of the sound delivered through the tube 10 to the ear canal, thereby smoothing and reducing peaks in the frequency response of the hearing aid device. Alternately, a tip can be selected that partially occludes the ear canal, resulting in more mid frequency gain.

The tip 12 can also include a horn to improve the frequency response of the receiver. Although horns have been used in conventional hearing aid designs, traditional designs require that the tubing be widened out one or two centimeters before the end of the tube. This can result in the tube being more visible than desired.

Figure 3A:
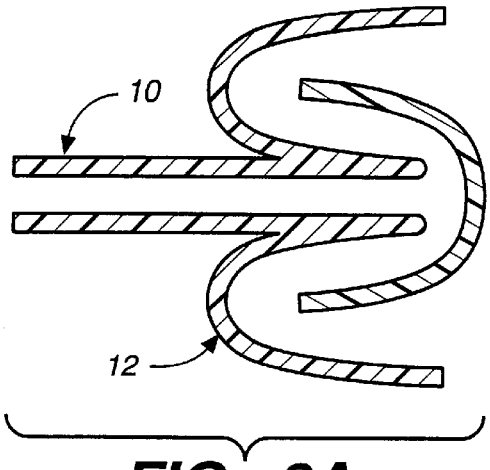
FIGS. 3*a*–3*b* show ear canal tube configurations according to additional embodiments of the present invention.
Figure 3B:
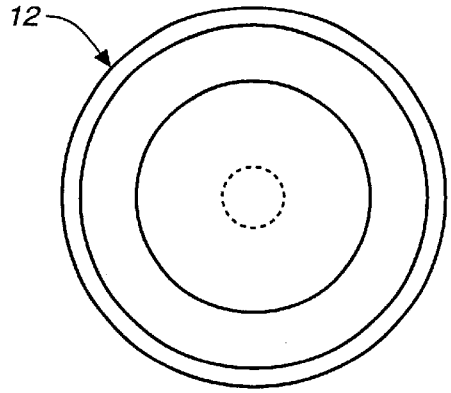
Figure 3C:
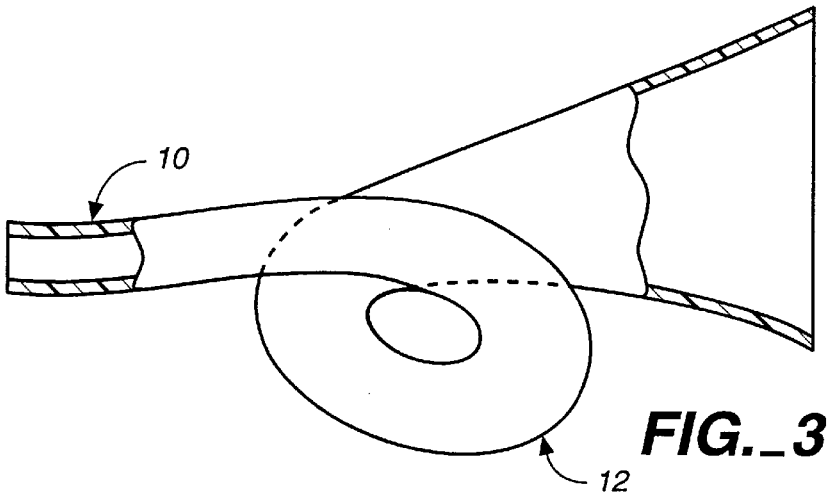
Figure 3D:
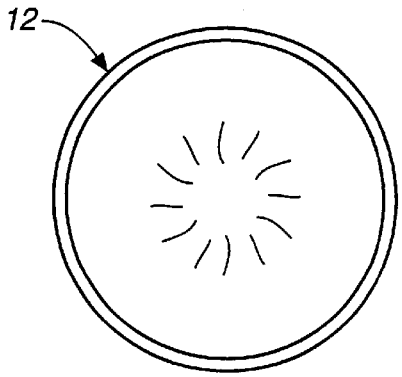

According to the present invention, the horn can be provided at the tip. Examples of ear canal tube configurations employing horns according to the present invention are shown in FIGS. 3*a*–3*d*. In FIG. 3*a*, the tube opening folds back over the outside of the tube 10 and then folds back forward again. FIG. 3*b* shows an end view of the ear canal tube configuration shown in FIG. 3*a*. In FIG. 3*c*, the tube 10 forms a trumpet, i.e., a loop that gradually widens. FIG. 3*d* shows an end view of the ear canal tube configuration shown in FIG. 3*c*.

Instead of a horn at the tip 12 where the diameter gradually widens, there can also be a stepped diameter change. For example, the tube 10 can have an inner diameter of 0.025 inches for most of its length but have an inner diameter of 0.045 inches for the last 0.40 inch. This provides a boost to frequencies in the 4 kHz region.

All of these techniques for forming the tip to adjust the frequency shape can be less expensive and less complex than using the electronic adjustments discussed above with reference to FIG. 2.

Figure 4A:
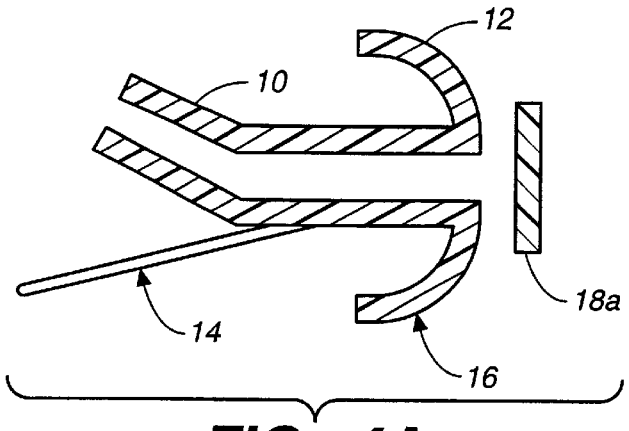
FIGS. 4*a*–4*b* show open ear canal hearing aid systems according to additional embodiments of the present invention.
Figure 4B:
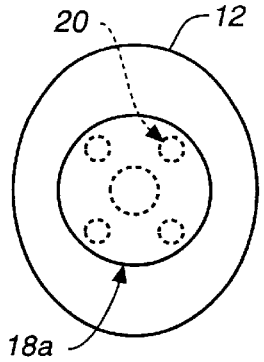
Figure 4C:
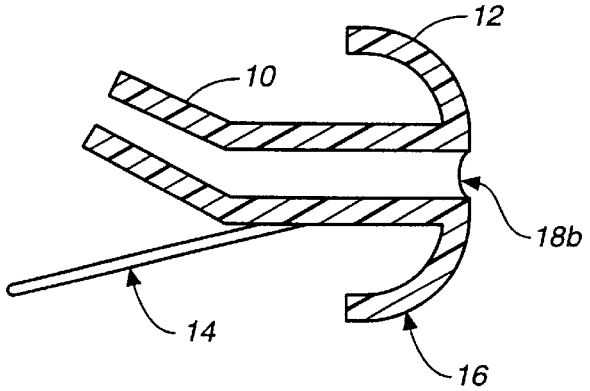
Figure 4D:
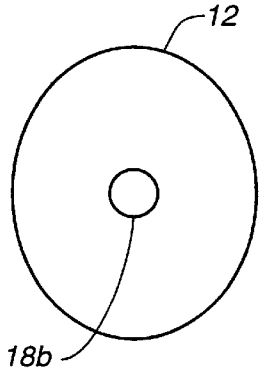

Yet another advantage of using separate tips is that the tips can be easily replaced or removed for cleaning. Wax and moisture pose potential problems for the tip. FIGS. 4*a*–4*d* show open ear canal hearing aid systems for reducing wax and moisture buildup according to the present invention. In FIG. 4*a*, the tube orifice is covered with a wax block 18*a* such that, during the insertion of the tube 10 in the ear, wax is prevented from entering the tube. FIG. 4*b* shows an end view of the open ear canal hearing aid system shown in FIG. 4*a*, including wax block supports 20. In FIG. 4*c*, a thin membrane 18*b* covers the tube ending. This membrane can be made of plastic. The membrane 18*b* prevents wax and moisture from entering the tube 10 but is nearly transparent to audio frequencies. The membrane 18*b* can be made stiff so that low frequencies are attenuated. FIG. 4*d* shows an end view of the open ear canal hearing aid system shown in FIG. 4*c*.

Figure 5A:
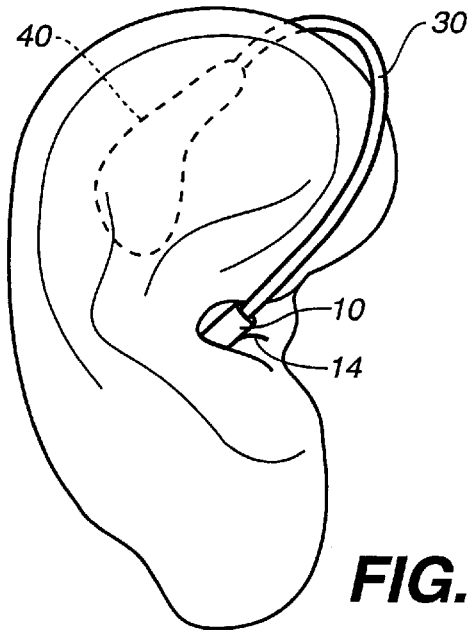
FIGS. 5*a* and 5*b* show an exemplary fitting of an open ear canal hearing aid system in the ear of a user according to one embodiment of the present invention.
Figure 5B:
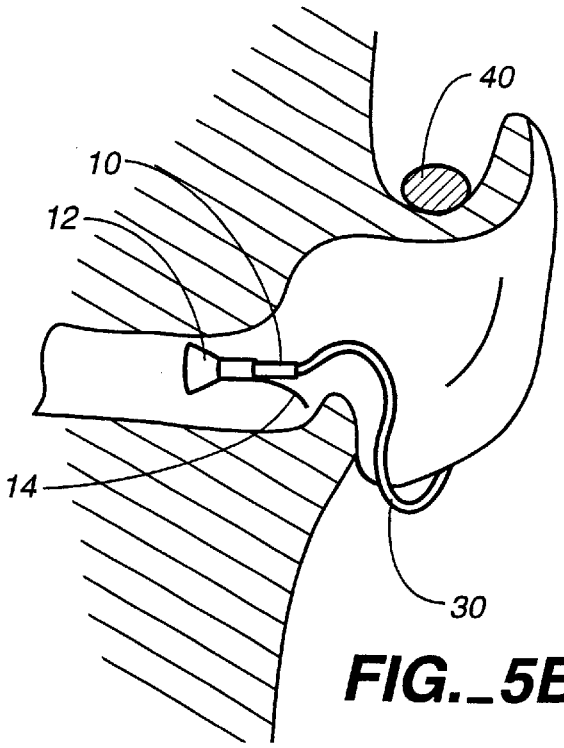

FIGS. 5*a* and 5*b* show the fitting of the open ear canal hearing aid system 1 in a BTE configuration. As shown in FIG. 5*a*, the ear canal tube 10 fits within the ear canal, and the barb 14 is positioned to hold the ear canal tube 10 in the ear canal. The hearing aid tube 30 is then formed to extend behind the ear and connected to the case 40 which is placed, for example, behind the ear. A different view of the fitting of the open ear canal hearing aid system is shown in FIG. 5*b* which illustrates a cross section of the fitting of the open ear canal hearing aid system in the ear of a user.

The tubes 10 and 30 can be formed to fit the user in variety of different ways. For example, the best fitting tubing can be selected from a kit of manufactured tubes of different shapes and sizes. In a similar manner, the tips can be selected from a manufactured kit of tips. Thus, the user can select the tubes that fit the external ear and then select the tip that fits the ear canal shape.

Another way the tubes 10 and 30 can be formed to fit the user is by custom fitting. For example, the tubing can be made from thermo formable tubing, such as heat shrink tubing. Prior to fitting the tubing to the user, it is first shrunk and then formed to the approximate correct size using, for example, a jig. A 0.01 to 0.015 inch diameter soft malleable wire formed of, for example, copper, is placed through the tubing. The copper wire is left in the tubing and fit on the user's ear with a small, soft rubber portion covering the tip of the sharp tube end. The copper wire allows the tubing to be properly fitted for each user. The tubing is then removed from the user and heated with a hot air gun to lock in the shape. The copper wire is then removed, and minor adjustments can be made with the hot air gun at a lower heat to ensure a proper fit.

Figure 6:
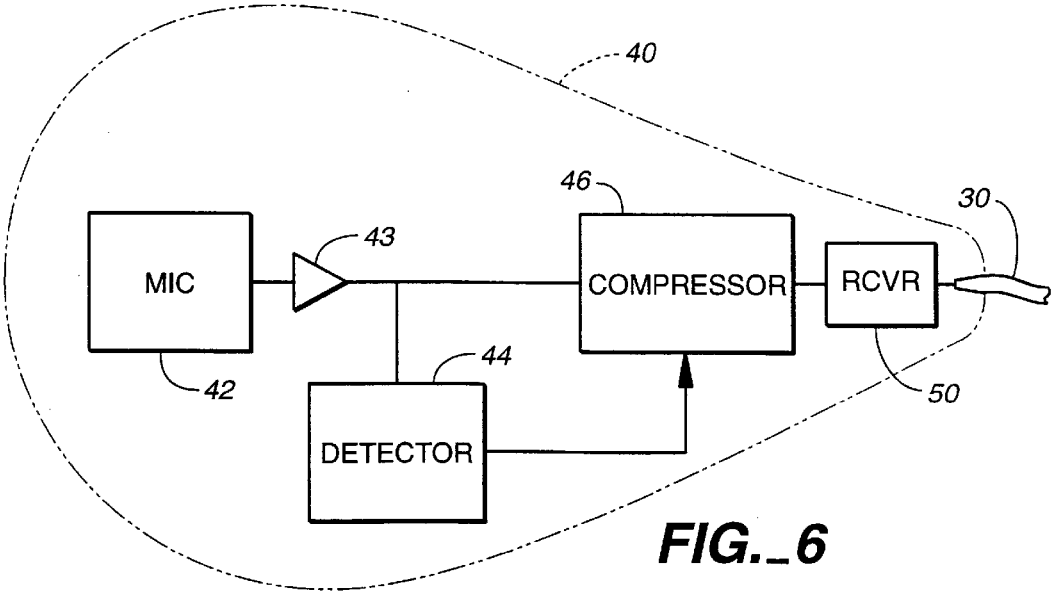
FIG. 6 is a functional block diagram of the circuitry enclosed in the case of the open ear canal hearing aid system according to one embodiment of the present invention.

FIG. 6 shows a block diagram of exemplary circuitry enclosed by the case 40 according to one embodiment of the present invention. The case 40 encloses a microphone 42 for receiving sounds, a preamplifier 43 for amplifying sounds received by the microphone, and a sound processor for processing the preamplified sounds. The sound processor comprises a detector 44 for detecting whether the received sounds are within a predetermined frequency and amplitude range and a compressor 46 for adjusting the gain of the received sounds responsive to the output of the detector 44. The case 40 also encloses a receiver 50 which is an output device, such as a loudspeaker, that converts processed signals output from the compressor 46 into audible sounds and delivers these sounds to the hearing aid tube 30.

In this embodiment, a conventional preamplifier and microphone and a receiver such as the Knowles model EH 3065 are placed in standard locations. However, the microphone and receiver can be positioned in other locations. For example, the microphone can be placed higher or lower on the head, and the receiver can be placed closer to the ear canal.

Because people with mild hearing losses make up the largest segment of hearing aid users, an exemplary embodiment of the open ear hearing canal system 1 is designed for these users. Therefore, a predetermined frequency and amplitude range that is detected for correcting these mild hearing losses includes a range of sounds at high frequencies and low amplitudes. High frequency sounds are, for example, considered to be sounds having frequencies greater than 1000 Hz, and low frequency sounds are considered to be sounds having frequencies less than 1000 Hz. Exemplary low amplitude sounds are those with less than 60 to 70 decibels of sound pressure level (dB SPL).

For mild hearing loss users, there is no hearing loss in the low frequency range. Thus, at low frequencies, the dynamic range is normal and there is no need for compression. Instead of the traditional approach of linearly processing low frequency sounds with low gain, according to exemplary embodiments of the present invention, the low frequency sounds are transmitted using the natural pathway of the ear canal. This eliminates the distortion of loud low frequency signals that can be caused by compression and can degrade speech intelligibility.

In the high frequency range, mild hearing loss users experience a reduced dynamic range and a need for compression. Gain is not needed for mild hearing loss users for loud sounds in the high frequency range. Thus, according to exemplary embodiments of the present invention, gain is only provided for soft sounds in the high frequency range. This eliminates the distortion of loud high frequency signals that can be caused by compression and can degrade speech intelligibility.

According to an exemplary embodiment of the present invention, the compressor 46 performs compression primarily on high frequency, high amplitude signals, applying the same amount of compression to the entire high frequency band. Alternately, the compressor 46 can perform multiband compression of sound signals, applying different amounts of compression to different high frequency signals having different amplitudes and allowing the low frequency sounds to pass without compression.

The detector 44 can be implemented, for example, with a conventional high pass band filter connected in series with a conventional amplitude level detector. The level detector outputs different signals to the compressor 46 representing the amplitude level detected.

The compressor 46 can be implemented, for example, with the multiband compressors described in U.S. Pat. Nos. 5,278,912 and 5,488,668 to Waldhauer applied to primarily high frequency sound signals. The disclosures of these patents are hereby incorporated by reference in their entireties. Alternately, the compressor 46 can be implemented with a conventional compressor in combination with a high pass band filter, so that compression is applied primarily to high frequency sounds.

When the detector 44 determines that the received sound is within the predetermined frequency and amplitude range, the compressor 46 adjusts the gain for amplifying the received sound. More particularly, the compressor 46 adjusts the gain as a function of the amplitude level detected by the detector 44. For instance, when the detector outputs a signal to the compressor indicating that the received sound is at a low amplitude level, a maximum gain is provided. As the amplitude level increases the compressor reduces the gain until, for the highest amplitude levels, the maximum compression is reached, resulting in zero gain. As a result, unnecessarily high gain or distortion is prevented from adversely affecting sounds at the higher amplitude levels.

The sound processor primarily supplements the received sounds in a predetermined frequency and amplitude range. Because most mild hearing loss users have nearly normal hearing for sounds at low frequencies, it is not necessary to supplement sounds received outside of the predetermined frequency and amplitude range. Thereby, the open ear canal hearing aid system of the present invention allows these frequencies to be heard in a natural manner without amplifying or attenuating these sounds.

Figure 7:
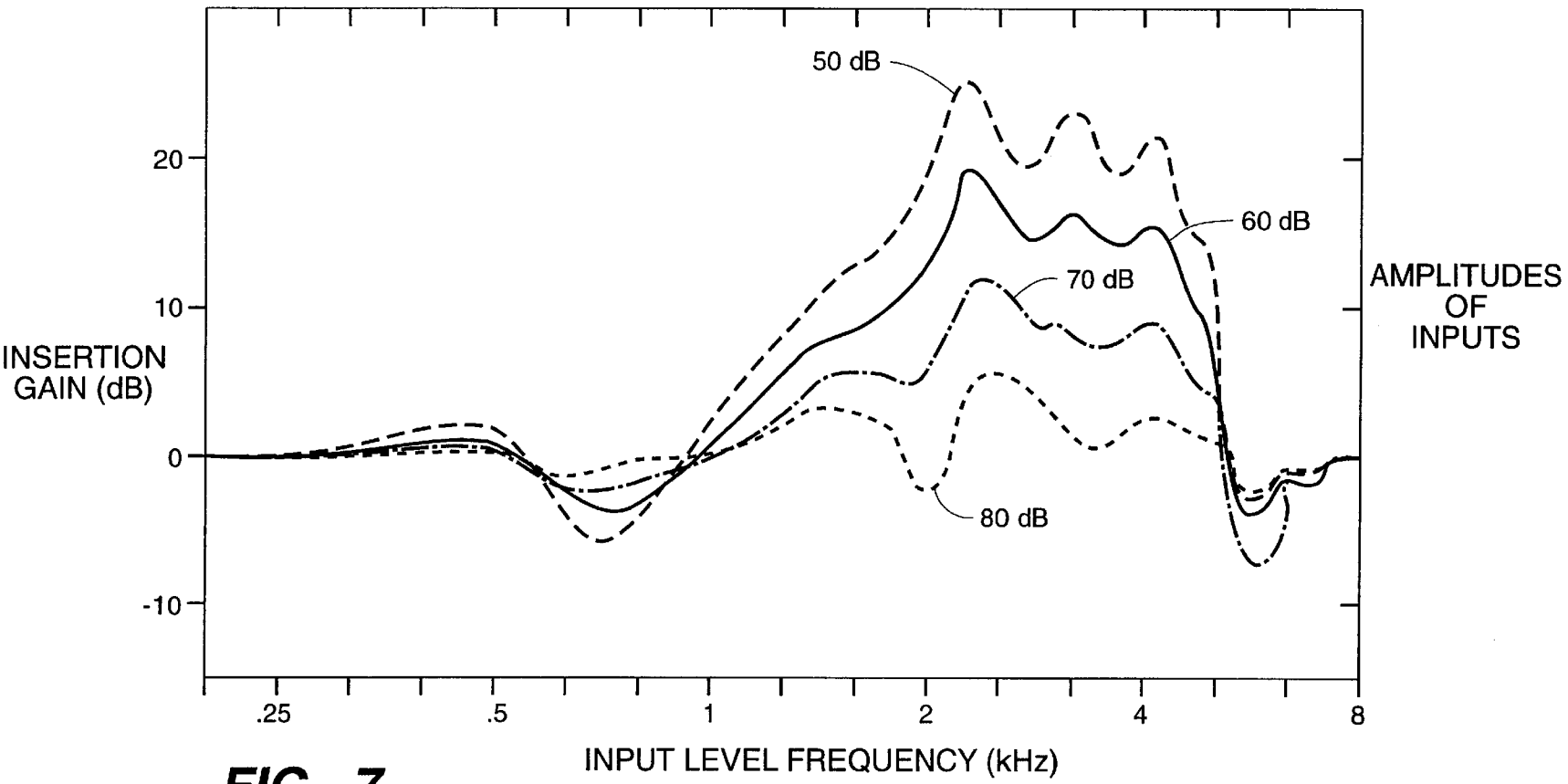
FIG. 7 is a graph which represents an example of the insertion gain provided for sounds at various frequencies received by the open ear canal hearing aid system according to one embodiment of the present invention.

FIG. 7 shows an exemplary graph of the insertion gain provided at different sound frequencies for a hearing aid system according to one embodiment of the present invention. This graph shows that there is little gain or attenuation at frequencies below 1000 Hz, while at high frequencies (greater than 1000 Hz), 20 dB of gain is present for the softest sounds and near 0 dB of gain is provided for high amplitude sounds (near 80 dB SPL). These frequency and amplitudes ranges can be determined from measurement of the environment and can be fixed in advance in the interest of simplicity.

Because of the nature of the open ear canal hearing aid system 1, there is a greater possibility of feedback than with conventional, sealed canal hearing aids. That is, with an open ear canal, sound emanates from the open canal with little attenuation. The microphone 42 picks up sound from both distant sources and sound coming out of the ear canal. The sound coming out of the ear canal causes feedback.

Mild hearing loss users do not need a large amount of gain, and the feedback problems are therefore somewhat lessened. However, because the microphone is normally located above the pina, there is only minimal attenuation of sound before reaching the microphone. This can result in the possibility of feedback with even small hearing aid gain.

There are various possibilities for reducing feedback. For example, the microphone 42 can be moved away from the ear canal to reduce the responses from the receiver 50 while maintaining the response to external sound sources. An extension tube can be added over the microphone port to extend the microphone pickup point several centimeters away from the ear canal. In an exemplary embodiment, clear tubing with an outside diameter of 0.045 inches can be used for the extension tube. This tubing is not very visible and can be hidden somewhat by a user's hair.

This extension tubing has several advantages. One advantage is that it provides a low cost means to reduce feedback. No special electronics are required, and the tubing is very inexpensive. Another advantage is that the extension tubing can be used only when needed. If only low gain is needed such that feedback is not much of a problem, then the extension tubing can be removed. If high gain is needed, an extra long extension tube can be used. Another advantage is that the acoustics of the extension tubing can be modified to provide an inexpensive means to shape the frequency responses.

Another way to reduce feedback in the hearing aid system is to use a directional microphone having a null in the direction of the feedback source. If the microphone 42 has a relatively high sensitivity to sounds coming from in front of the user (the external sources) and has a low sensitivity to sounds coming from the ear canal, then feedback is not much of a problem. Normally, directional microphones are used to reject noise coming from behind or beside the user. In this case, the directional microphone can be used to reject the feedback signal.

In an exemplary embodiment, a directional microphone can be constructed by placing two microphones about 0.4 inches apart and subtracting the outputs of the microphones. If one microphone is placed in front, towards the user's face, and the other microphone is placed behind, towards the back of the head, this produces a null of 90° to the line connecting them. The directional microphone can be placed, for example, about 1 to 2 centimeters above the ear canal, with the null pointing toward the canal opening.

Instead of subtracting the microphone outputs, a directional microphone can be formed by adding the outputs of two microphones. In this case, the microphones are most sensitive to inputs coming from a direction perpendicular to the line connecting the microphones. One microphone can be placed just about the pina, and a second microphone can be placed about 1–6 inches higher. Since the feedback signal is higher in amplitude at the lower microphone, the output of the lower microphone is attenuated before being added to the output of the top microphone. The result is a null in the direction of the ear canal, but in this case the null is only for a frequency where the distance between the microphones is equal to the wave length λ, divided by 2.

Yet another way to reduce feedback is by partially blocking the ear canal. Standard hearing aids employ blocking of the ear canal. However, according to the present invention, feedback can be reduced by blocking the ear canal much less than in the standard hearing aid designs. For example, the design shown in FIG. 1 can be made with a diameter of the tube 10 large enough to partially block the canal.

Yet another way to reduce feedback is to make the receiver 50 directional. Multiple outputs from the ear canal tube can thus be added in the preferred direction for cancelling sounds in the feedback direction. In an exemplary embodiment, one or more receivers can be designed so that sound is transmitted with higher amplitude toward the ear drum than it is in the other direction. For example, two receivers can be used, the outputs of the receivers being inverted (180° out of phase with each other). If one receiver is positioned inside the ear canal, and one is positioned at the entrance to the ear canal with a longer tube length, the feedback signal is less than from one receiver alone. The directional receiver thus can be referred to as an "active feedback cancellation" device since the second receiver functions to cancel the first.

In an exemplary embodiment, the directional receivers can be constructed using a receiver with two ports. Analogous to directional microphones, one port then has an output 180° out of phase from the other port.

The directional receiver can be used together with the directional microphone or partial blocking of the ear canal. The directional receiver has the advantage over the directional microphone that since both receiver ports are in or near the ear canal, it is less sensitive to changes in the feedback path due to reflecting objects nearby or changes in the speed of sound due to temperature and barometric pressure.

In view of the foregoing, it can be appreciated that the open ear canal hearing aid system provides a simplified hearing aid that allows the user to hear as many sounds as possible in a natural manner. Because this open ear canal hearing aid system only adjusts sounds that the user has difficulty hearing, sounds can be heard by the user in a more natural manner. The open ear canal hearing aid system also reduces the occlusion effect so that the sounds heard are more comfortable to the user. In addition, since high amplitudes are not generated by the aid, smaller components can be used for this hearing aid system which further increases the comfort of the hearing aid for the user and provides a cosmetically appealing design.

The hearing aid system discussed in the exemplary embodiments above is optimized for users having mild hearing losses. It should be apparent, however, that the open ear canal hearing aid system according to the present invention can also be designed to aid other hearing losses. For instance, users having hearing impairments for sounds at low frequencies and low amplitudes that can hear high frequency sounds in a normal manner can use the same principles described above to supplement low frequency sounds. Similarly, the principles described above can be used for users having hearing impairments for sounds at high frequencies and high amplitudes and for sounds at low frequencies and high amplitudes. The detector 44 only needs to be modified to detect the predetermined frequency and amplitude ranges for sounds at the frequencies and amplitudes for which the user has an impairment, and the compressor 46 needs to be modified to amplify the received sounds at the appropriate frequency range. Of course, it will be understood that at low frequencies, the open ear canal "leaks off" sounds, so supplying gain in that range requires mores power. In addition, high amplitude and high frequency signals are, for many losses, heard sufficiently without requiring amplification.

The invention being thus described, it will be apparent to those skilled in the art that the same can be varied in many ways. Such variations are not to be regarded as a departure from the spirit and scope of the invention, which is determined by the following claims. All such modification that would be obvious to one skilled in the art are intended to be included within the scope of the following claims.

What is claimed is:

1. A hearing aid system comprising:

an ear canal tube sized for positioning in an ear canal of a user; and a sound processor having a compressor for amplifying received ambient sounds included within a predetermined amplitude and frequency range that is selected as a function of the ear canal tube size to produce processed sounds and for supplying said processed sounds to said ear canal tube wherein said ear canal tube is sized so that an ear canal of the user is at least partially open for receiving and delivering ambient sounds directly to a tympanic membrane of the user.

2. A hearing aid system according to claim 1, wherein the predetermined amplitude and frequency range is also selected for a predetermined level of hearing loss.

3. A hearing aid system according to claim 2, wherein said frequency range is greater than 1 kHz, and said amplitude range is less than 70 dB of sound pressure level (SPL).

4. A hearing aid system according to claim 1, wherein said ear canal tube has an inside diameter of less than 0.030 inches and an outside diameter of less than 0.050 inches.

5. A hearing aid system according to claim 1, wherein said ear canal tube comprises a barb at a tip securing said ear canal tube in the ear canal of the user.

6. A hearing aid system according to claim 5, wherein the barb extends outward from the ear canal tube and lodges behind the tragus.

7. A hearing aid system according to claim 1, wherein feedback due to sound emanating from the ear canal is reduced.

8. A hearing aid system according to claim 1, comprising a microphone for receiving sounds, wherein said sound processor comprises a detector for detecting whether the sounds received by said microphone are within said predetermined amplitude and frequency range and said compressor applies compression and amplification to said sounds responsive to said detection.

9. A hearing aid system according to claim 8, wherein said compressor applies the same amount of compression to sounds within a predetermined frequency range.

10. A hearing aid system according to claim 9, wherein said predetermined frequency range includes frequencies greater than 1 kHz.

11. A hearing aid canal system according to claim 8, wherein said compressor applies different amounts of compression to sounds within a predetermined frequency range.

12. A hearing aid system according to claim 11, wherein said predetermined frequency range includes frequencies greater than 1 kHz.

13. A hearing aid system according to claim 1, comprising:

means for shaping the frequency response of the sound processor.

14. A hearing aid system according to claim 1, wherein said ear canal tube has an outside diameter of less than approximately 0.085 inches.

15. A hearing aid system according to claim 14, wherein said ear canal tube has an inside diameter of less than approximately 0.053 inches.

16. A hearing aid system according to claim 1, wherein the compressor amplifies received ambient sounds as a function of the amplitude level of the received ambient sounds.

17. A hearing aid system according to claim 1, wherein the ear canal tube is sized for placement of the sound processor behind an ear of the user.

18. A hearing aid system comprising:

an ear canal tube sized for positioning in an ear canal of the user, said ear canal tube having an outside diameter of less than approximately 0.085 inches; and a sound processor for amplifying received ambient sounds included within a predetermined amplitude and frequency range to produce processed sounds and for supplying said processed sounds to said ear canal tube wherein said ear canal tube is sized so that an ear canal of the user is at least partially open for receiving and delivering ambient sounds directly to a tympanic membrane of the user.

19. A hearing aid system according to claim 18, wherein the predetermined amplitude and frequency range is also selected for a predetermined level of hearing loss.

20. A hearing aid system according to claim 18, wherein said frequency range is greater than 1 kHz, and said amplitude range is less than 70 dB of sound pressure level (SPL).

21. A hearing aid system according to claim 18, wherein said ear canal tube has an inside diameter of less than 0.030 inches and an outside diameter of less than 0.050 inches.

22. A hearing aid system according to claim 18, wherein said ear canal tube comprises a barb at a tip securing said ear canal tube in the ear canal of the user.

23. A hearing aid system according to claim 22, wherein the barb extends outward from the ear canal tube and lodges behind the tragus.

24. A hearing aid system according to claim 18, wherein feedback due to sound emanating from the ear canal is reduced.

25. A hearing aid system according to claim 18, comprising a microphone for receiving sounds, wherein said sound processor comprises a detector for detecting whether the sounds received by said microphone are within said predetermined amplitude and frequency range and a compressor for applying compression and amplification to said sounds responsive to said detection.

26. A hearing aid system according to claim 25, wherein said compressor applies the same amount of compression to sounds within a predetermined frequency range.

27. A hearing aid system according to claim 26, wherein said predetermined frequency range includes frequencies greater than 1 kHz.

28. A hearing aid canal system according to claim 25, wherein said compressor applies different amounts of compression to sounds within a predetermined frequency range.

29. A hearing aid system according to claim 28, wherein said predetermined frequency range includes frequencies greater than 1 kHz.

30. A hearing aid system according to claim 18, comprising:

means for shaping the frequency response of the sound processor.

31. A hearing aid system according to claim 18, wherein said ear canal tube has an inside diameter of less than approximately 0.053 inches.

32. A hearing aid system according to claim 18, wherein the sound processor amplifies the received ambient sounds as a function of the amplitude level of the received ambient sounds.

* * * * *